United States Patent [19]

St-Germain

[11] Patent Number: 4,858,724

[45] Date of Patent: Aug. 22, 1989

[54] SAFETY FENCE FOR SCAFFOLDS

[76] Inventor: Jean St-Germain, 1350, rang Saint-Georges Saint-Simon, Canada, J0H 1Y0

[21] Appl. No.: 245,461

[22] Filed: Sep. 2, 1988

[51] Int. Cl.[4] ..... E04G 1/26

[52] U.S. Cl. ..... 182/113; 182/137; 256/59; 256/DIG. 6

[58] Field of Search ..... 182/113, 106, 222, 223, 182/179, 186, 137; 526/DIG. 6, 59, 65

[56] References Cited

U.S. PATENT DOCUMENTS

| | | | |
|---|---|---|---|
| 516,606 | 3/1894 | Mann et al. | 182/113 |
| 3,863,899 | 2/1975 | Werner | 256/59 |
| 3,901,481 | 8/1975 | Probst | 182/113 |
| 4,248,326 | 2/1981 | Hansen | 182/186 |
| 4,480,819 | 11/1984 | Lopez | 182/113 |
| 4,565,261 | 1/1986 | Maier | 182/113 |

*Primary Examiner*—Reinaldo P. Machado

[57] ABSTRACT

A safety fence for scaffolds of the type having flat end portions is disclosed. The fence comprises a rectangular framework, upright when installed and provided with a bottom slot for slidably receiving an end portion of the scaffold. A second framework is rigidly fixed to the bottom of the main framework and forms a second slot to slidably receive the end portion of the scaffold, and this maintains the framework in secure immobile upright position.

6 Claims, 1 Drawing Sheet

SAFETY FENCE FOR SCAFFOLDS

FIELD OF THE INVENTION

The present invention relates generally to construction equipment, more particularly to a fence adapted to be positioned at the end portions of building scaffolds.

BACKGROUND OF THE INVENTION

Scaffolds are used for construction repair, maintenance, etc. of buildings. Typically such scaffolding includes a support structure of rigid members upon which are placed at vertically-spaced intervals flat horizontal planks, usually made of wood. the planks support one or more workmen, along with their tools and equipment.

The end portions of these planks are left open and unprotected. There is consequently a danger of losing or spilling of tools or equipment over the end edges of the planks, or even of a worker falling off the scaffolding.

OBJECTS OF THE INVENTION

In view of the above, it is a prime object of the present invention to provide a safety fence for a scaffold which effectively prevents any accident or loss of equipment at the end portions of scaffold planks.

It is another object of the present invention to provide a safety fence of the character described, which can be installed in a matter of seconds and very easily.

It is another object of the present invention to provide a safety fence of the character described, which is simple in design.

SUMMARY OF THE INVENTION

The above and other objects and advantages of the present invention are realized according to a preferred embodiment comprising: a rigid rectangular framework, preferably provided with a screen at least at its lower portion. The framework is vertical when installed.

The lower portion of the framework fence is provided with a scaffold attachment means. The latter has two sides from each of which projects a rigid connection means having a free end to which is connected a framework anchoring means. Such anchoring means may be securely fixed to a scaffold plank or not, as desired.

BRIEF DESCRIPTION OF THE DRAWINGS

The above will be more clearly understood by having referral to the preferred embodiment of the invention, illustrated by way of the accompanying drawings, in which.

Like numerals indicated like elements throughout the drawings.

DETAILED DESCRIPTION OF THE PREFERRED EMBODIMENT

Figure 1:
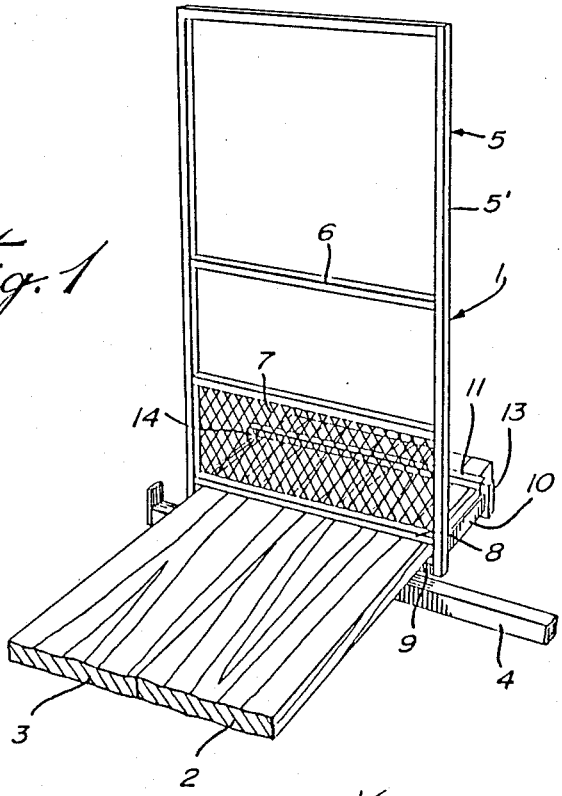
FIG. 1 is a perspective view of the fence of the invention installed on the end portions of a pair of scaffolding planks.
Figure 2:
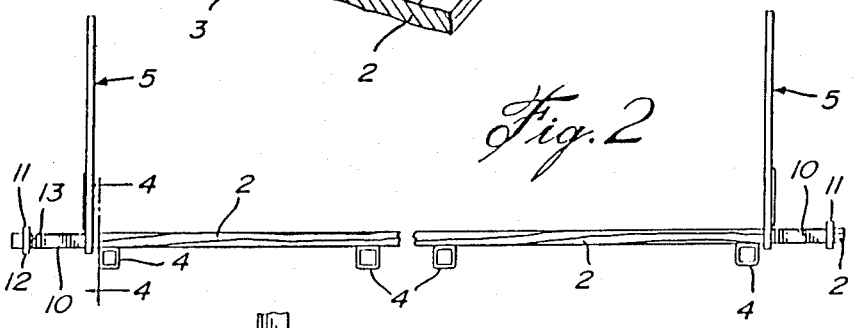
FIG. 2 is a lateral elevation of scaffolding plank end portions, part of a scaffolding structure, and the fence of FIG. 1 installed at both end portions.
Figure 3:
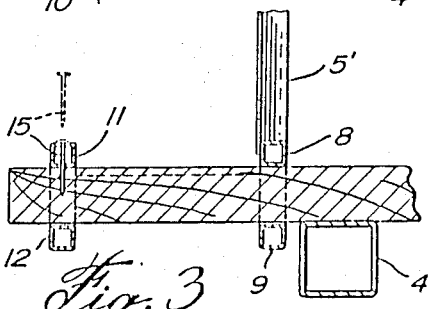
FIG. 3 is an enlarged view, in longitudinal cross-section, of the left end portion of FIG. 2.
Figure 4:
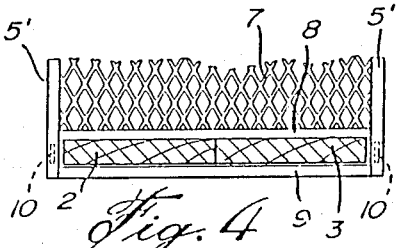
FIG. 4 is a cross-sectional view taken along line 4—4 of FIG. 2.

Referring firstly to FIG. 1, there is shown a fence 1 mounted at the end portion of scaffolding planks 2, 3. The scaffolding itself typically consists of cross-members 4 (cf also FIG. 2) and other members and struts (not shown).

Fence 1 consists of a rectangular upright framework 5, including a mid-length reinforcing member 6 and a lower grill 7.

The plank scaffold attachment means comprises a rectangular slot formed of upper and lower transverse members 8 and 9 joined at their respective opposite ends by the lower ends of vertical bars 5' of framework 5. Rigidly secured, by welding or any other suitable means, to bars 5', are a pair of longitudinal rigid members 10 which constitute the connection means disclosed above.

The framework anchoring means consists of another rectangular slot in horizontal registry with the first-named rectangular slot and spaced away from the latter by the two rigid members 10. This second-named rectangular slot is formed of upper and lower transverse members 11, 12, respectively, similar to the members 8 and 9 and joined on each side by end members 13 and 14.

In order to install the fence of the invention on such a scaffold, a workman only has to push the upright framework inwardly, such that the two rectangular slots engage the planks 2 and 3.

If the fence is needed on the scaffold for an extended period of time, upper member 11 of the stabilizing means may be provided with holes, so that one or more nails 15 can be driven into the planks 2 and 3.

I claim:

1. A safety fence for a scaffold, said scaffold having at least one flat outer end portion, said fence comprising a rigid framework, a screen provided at at least at the lower portion of the framework, a scaffold attachment means provided at the bottom of said framework; rigid connection means projecting longitudinally of said attachment means on each side thereof, each said side having a free end, and a framework anchoring means connected to said free ends of said connection means.

2. A safety fence for a scaffold as defined in claim 1, wherein said scaffold attachment means consists of a rectangular slot defined by an upper and a lower transverse member joined at their respective opposite ends by the lower ends of said framework; said flat outer end portion of said scaffold being adapted to extend through said rectangular slot, whereby said framework is placed in vertical position.

3. A safety fence for a scaffold as defined in claim 2, wherein said connection means consists of a pair of longitudinal rigid members secured to said lower ends of said framework on each said side of the latter respectively.

4. A safety fence for a scaffold as defined in claim 3, wherein said framework anchoring means consists of another rectangular slot, disposed transversely and spaced apart from the first-named transverse slot, and in registry with the latter, the second-named rectangular slot being defined by another pair of upper and lower transverse members joined on each side by an end member vertically disposed; said end member being rigidly secured to said free ends of each said longitudinal rigid member.

5. A safety fence for a scaffodl as defined in claim 4, wherein said flat outer end portion is constituted by at least one wooden plank.

6. A safety fence for a scaffold as defined in claim 5, wherein said upper member of the second-named rectangular slot is provided with at least one hole, whereby said anchoring means can be fixedly temporarily secured to said wooden plank by a nail and the like.

* * * * *